US009851117B2

(12) United States Patent
Miura et al.

(10) Patent No.: US 9,851,117 B2
(45) Date of Patent: Dec. 26, 2017

(54) NEED IDENTIFYING DEVICE, AIR-CONDITIONING CONTROLLING SYSTEM, NEED IDENTIFYING METHOD, AND AIR-CONDITIONING CONTROLLING METHOD

(71) Applicant: Azbil Corporation, Tokyo (JP)

(72) Inventors: Mayumi Miura, Tokyo (JP); Ryota Dazai, Tokyo (JP); Masato Tanaka, Tokyo (JP)

(73) Assignee: Azbil Corporation, Tokyo (JP)

( * ) Notice: Subject to any disclaimer, the term of this patent is extended or adjusted under 35 U.S.C. 154(b) by 695 days.

(21) Appl. No.: 14/308,944

(22) Filed: Jun. 19, 2014

(65) Prior Publication Data

US 2014/0374496 A1 Dec. 25, 2014

(30) Foreign Application Priority Data

Jun. 21, 2013 (JP) ..... 2013-130316

(51) Int. Cl.
*F24F 11/00* (2006.01)

(52) U.S. Cl.
CPC ..... *F24F 11/001* (2013.01); *F24F 11/0012* (2013.01); *F24F 11/0015* (2013.01); *F24F 2011/0057* (2013.01)

(58) Field of Classification Search
CPC ..... F24F 11/0012; F24F 11/0015; F24F 2011/0057; F24F 2011/0061; F24F 2011/0063
See application file for complete search history.

(56) References Cited

U.S. PATENT DOCUMENTS 5,436,852 A * 7/1995 Kon ..... G01W 1/17 236/91 C
5,762,265 A * 6/1998 Kitamura ..... F24F 11/006 165/205
2005/0284158 A1* 12/2005 Lee ..... F24F 11/001 62/126
2006/0184283 A1* 8/2006 Lee ..... F24F 11/0017 700/276

(Continued)

FOREIGN PATENT DOCUMENTS

CN 1727792 A * 2/2006
JP 2007255835 A 10/2007

(Continued)

*Primary Examiner* — Etsub Berhanu
*Assistant Examiner* — Nelson Nieves
(74) *Attorney, Agent, or Firm* — Oblon, McClelland, Maier & Neustadt, L.L.P.

(57) ABSTRACT

A need identifying device is provided with a need storing portion that receives, from an informant, a need pertaining to the surrounding environment, an environment state variable controlling portion that calculates an environment state variable for indicating the state of the surrounding environment of the informant based on an environment element measured value collected from a space occupied by the informant, and calculates, from the environment state variable, a dissatisfaction level for the surrounding environment of the informant, and an identification processing portion that identifies, based on the dissatisfaction level, a need from the informant as a temporary need or as a persistent need.

4 Claims, 11 Drawing Sheets

(56) References Cited

U.S. PATENT DOCUMENTS

| | | | | |
|---|---|---|---|---|
| 2006/0283964 | A1* | 12/2006 | Garozzo | G05D 23/1905 236/46 R |
| 2009/0159717 | A1* | 6/2009 | Tsai | F24F 11/0017 236/44 A |
| 2010/0070089 | A1* | 3/2010 | Harrod | F24F 11/0086 700/277 |
| 2011/0295544 | A1* | 12/2011 | Ueda | F24F 11/006 702/130 |
| 2012/0239324 | A1 | 9/2012 | Ueda et al. | |
| 2013/0048263 | A1* | 2/2013 | Nouvel | F24F 11/0009 165/237 |
| 2013/0060391 | A1* | 3/2013 | Deshpande | F24F 11/0009 700/291 |

FOREIGN PATENT DOCUMENTS

| | | | |
|---|---|---|---|
| JP | 2009-109034 | A | 5/2009 |
| JP | 2010-025547 | A | 2/2010 |
| JP | 2012-194847 | | 10/2012 |
| KR | 10-2012-0115087 | A | 10/2012 |

* cited by examiner

NEED IDENTIFYING DEVICE, AIR-CONDITIONING CONTROLLING SYSTEM, NEED IDENTIFYING METHOD, AND AIR-CONDITIONING CONTROLLING METHOD

CROSS REFERENCE TO RELATED APPLICATION

This application claims priority under 35 U.S.C. §119 to Japanese Patent Application No. 2013-130316, filed on Jun. 21, 2013, the entire content of which being hereby incorporated herein by reference.

FIELD OF TECHNOLOGY

The present disclosure relates to a need identifying device and need identifying method for identifying whether a need regarding the surrounding environment from an informant is a temporary need or a persistent need, and relates to an air-conditioning controlling system and air-conditioning controlling method for applying the identification result to the air-conditioning control.

BACKGROUND

A summary of a method for evaluating whether or not a report from an occupant is for a temporary need, in a building that has equipment that is operated in response to an improvement need report from an occupant regarding the surrounding environment, has been disclosed in, for example, Japanese Unexamined Patent Application Publication 2012-194847 ("the JP '847").

For example, extreme movements in the indoor environment through a series of need reports by a specific individual that cause movement in one direction (such as movement in the direction of reducing the room temperature in air-conditioning equipment) in the equipment control are unavoidable due to the tendency for one occupant to have a negative impact on the environment for the other occupants of a building, such as an office, wherein multiple occupants share a space.

If the equipment control uniformly responds temporarily to a need report from an occupant, and then returns to the original control after a temporary response, then even if there are continuous need reports so as to move the equipment control in one direction, the negative impact on the environment will only be temporary. However, in such a temporary response, when there is an uncomfortable environment wherein the need to improve the room environment is strong, the uncomfortable environment will be improved only temporarily. In this case, even though the environment is improved temporarily through the equipment control operation in a temporary response to a need report from an occupant, eventually there will be a return to the uncomfortable environment, meaning that there is the need for the occupant to make reports continually over an extended period of time, which not only is burdensome and annoying to the occupant, but, in the worst case, causes a continuing environment with large mental and physical overhead.

The building facilities operating state evaluating device set forth in the JP '847 makes it possible to derive an evaluation index for evaluating correctly the operating state of the facilities in the building, making it possible to evaluate the operating state of the facilities correctly. However, with the building facilities operating state evaluating device disclosed in the JP '847, the evaluation is in relation to the energy aspects of the air-conditioning equipment (energy conservation), and thus even though it can prevent an increase in energy consumption, there is a problem in that it cannot respond adequately in regards to improving the indoor environment as felt by the occupants.

The present invention was created in order to solve the problem set forth above, and an aspect thereof is to provide a need identifying device, air-conditioning controlling system, need identifying method, and air-conditioning controlling method able to avoid extreme movements in the indoor environment caused by continual reports by a specific individual, along with reliably improving the indoor environment when the need to improve the indoor environment is great, while preventing unnecessary increases in energy consumption.

SUMMARY

A need identifying device according to the present disclosure includes: an inputting portion that receives, from an informant, a need pertaining to a surrounding environment; an environment state variable calculating portion that calculates an environment state variable for indicating the state of the surrounding environment of the informant, based on an environment element measured value collected from an occupied space of the informant; a dissatisfaction level deriving portion that estimates a dissatisfaction level regarding the surrounding environment of the informant based on the environment state variable; and an identification processing portion that identifies a need from an informant as a temporary need or a persistent need based on the dissatisfaction level.

Moreover, in one structural example of a need identifying device as set forth in the present disclosure, the dissatisfaction level deriving portion calculates the dissatisfaction level from the environment state variable, and the relationship between the environment state variable and the dissatisfaction level is a relationship wherein the dissatisfaction level increases monotonically in accordance with a worsening of the surrounding environment indicated by the environment state variable.

Moreover, in one structural example of a need identifying device as set forth in the present disclosure, the dissatisfaction level deriving portion estimates the dissatisfaction level from the environment state variable based on a relationship, established in advance, between the environment state variable and the dissatisfaction level, and the relationship between the environment state variable and the dissatisfaction level is a relationship wherein the dissatisfaction level increases monotonically in accordance with a worsening of the surrounding environment indicated by the environment state variable.

Moreover, in one structural example of a need identifying device as set forth in the present disclosure, if the dissatisfaction level is greater than a specific threshold value, the identification processing portion identifies the need from the informant as a persistent need, and if the dissatisfaction level is no greater than the specific threshold value, the identification processing portion identifies the need from the informant as a temporary need.

Moreover, in one structural example of a need identifying device as set forth in the present disclosure, the need from the informant is a need related to air-conditioning, the environment state variable indicates the state of the thermal environment in the space occupied by the informant, and the dissatisfaction level deriving portion estimates the dissatisfaction level in accordance with the state of the thermal environment indicated by the environment state variable.

Moreover, in one structural example of a need identifying device as set forth in the present disclosure, the need from the informant is a need related to air-conditioning, and the environment state variable indicates the state of the thermal environment in the space occupied by the informant. Further, when estimating the dissatisfaction level in accordance with the state of the thermal environment, indicated by the environment state variable, the dissatisfaction level deriving portion calculates a first dissatisfaction level when the informant feels too hot and a second dissatisfaction level when the informant feels too cold, and the identification processing portion identifies as a temporary need a need reported by the informant as too cold when the first dissatisfaction level is greater than the second dissatisfaction level or a need reported by the informant as too hot when the first dissatisfaction level is less than the second dissatisfaction level, and identifies other needs as persistent needs.

Moreover, in one structural example of a need identifying device as set forth in the present disclosure, the need from the informant is a need related to air-conditioning, and the environment state variable indicates the state of the thermal environment in the space occupied by the informant. Further, when estimating the dissatisfaction level in accordance with the state of the thermal environment, indicated by the environment state variable, the dissatisfaction level deriving portion calculates a first dissatisfaction level when the informant feels too hot and a second dissatisfaction level when the informant feels too cold, and the identification processing portion identifies, as a temporary need, a need reported by an informant as being too cold when an environment state variable changes to the side wherein the informant feels too hot and a need reported by an informant as being too hot when an environment state variable changes to the side wherein the informant feels too cold, and identifies other needs as persistent needs.

An air-conditioning controlling system according to the present disclosure includes: a need identifying device; a control plan storing portion that stores, in advance, respectively for temporary needs and for persistent needs, control plans wherein rules for changing control setting values for air-conditioning in accordance with a need from an informant are established; a control plan determining portion that determines a control plan, from the control plans stored in the control plan storing portion, a control plan corresponding to the identification result of the need identifying device, as a control plan to be applied to the air-conditioning equipment; and an equipment controlling portion that controls the air-conditioning equipment based on the control plan determined by the control plan determining portion.

Moreover, in one example structure of an air-conditioning controlling system according to the present disclosure, a control plan corresponding to a temporary need is a control plan that establishes that the control setting value will change in accordance with a need from an informant, and that the control setting value will be returned to the value from prior to the change after a specific sustaining time has elapsed, and a control plan corresponding to a persistent need is a control plan that establishes that the control setting value will be changed on a persistent basis in accordance with a need from the informant.

Moreover, a need identifying method according to the present disclosure includes: an inputting step for receiving, from an informant, a need pertaining to a surrounding environment; an environment state variable calculating step for calculating an environment state variable for indicating the state of the surrounding environment of the informant, based on an environment element measured value collected from an occupied space of the informant; a dissatisfaction level deriving step for estimating a dissatisfaction level regarding the surrounding environment of the informant based on the environment state variable; and an identifying step for identifying a need from an informant as a temporary need or a persistent need based on the dissatisfaction level.

Moreover, a need identifying method according to the present disclosure includes: each of the aforementioned steps; a control plan determining step for determining a control plan, from the control plans stored in a control plan storing portion, a control plan corresponding to the identification result of the identifying step, as a control plan to be applied to the air-conditioning equipment by referencing the control plan storing portion for storing, in advance, respectively for temporary needs and for persistent needs, control plans wherein rules for changing control setting values for air-conditioning in accordance with a need from an informant are established; and an equipment controlling step for controlling the air-conditioning equipment based on the control plan determined by the control plan determining step.

The present invention enables the calculation of an environment state variable indicating the state of the surrounding environment of an informant, to estimate a dissatisfaction level from the environment state variable, to identify whether a need from the informant is a temporary need or a persistent need. Consequently, using the identification result in the equipment control of the air-conditioning equipment, or the like, makes it possible to prevent unnecessary increases in energy consumption, possible to improve reliably the surrounding environment where the need to improve the surrounding environment is great, and possible to avoid extreme movements in the surrounding environment caused by continual reports by a specific individual.

Moreover, the present disclosure, through determining, as the control plan that is to be applied to the air-conditioning equipment, from among control plans that are stored in a control plan storing portion, a control plan corresponding to the identification result by the need identifying device, and by then controlling the air-conditioning equipment based on the control plan that has been determined, is able to apply the dedication result by the need identifying device to the air-conditioning control.

BRIEF DESCRIPTIONS OF THE DRAWINGS

DETAILED DESCRIPTION

Figure 1:
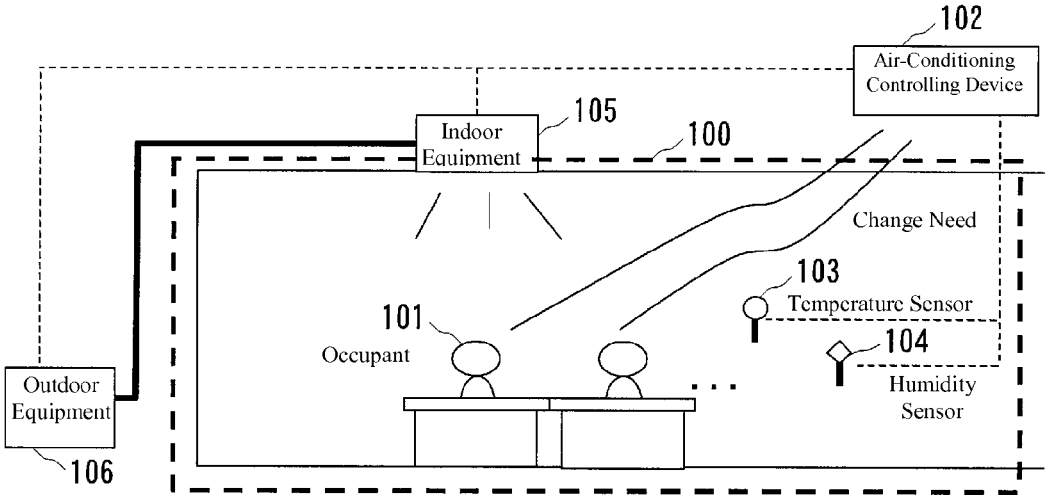
FIG. 1 is a diagram illustrating an example of an air-conditioning controlling system.

In the present disclosure, a contradictory report, which is a need report for which the probability of occurrence can be inferred, from the environment state variable of the occupied space, to be low is identified as a temporary need, and a non-contradictory report, which is a need report for which the probability of occurrence can be inferred, from the environment state variable, to be high is identified as a need that is not temporary (hereinafter termed a "persistent need"). Given this, in the present invention, if a need is identified as a temporary need, then by having the equipment control respond to this need be a temporary response, the change in the environment state variable when the temporary need continues can be kept to that which is temporary. Moreover, in the present invention, when a persistent need has been identified, the equipment control in response to that need report can be performed continuously. At this time, the relationship between the environment state variable and the dissatisfaction level with the surrounding environment by the need informant follows the dissatisfaction distribution, described below, so that a non-contradictory report (a persistent need) will eventually become a contradictory report (a temporary need) accompanying a change in the environment state variable.

Here, when the environment state variable is the horizontal axis and the dissatisfaction level of the need informant in relation to the surrounding environment is the vertical axis, the distribution of the dissatisfaction A of "Too Hot," corresponding to a hot environment, is a monotonic distribution wherein the dissatisfaction level A increases with an increase in the hotness that is indicated by the environment state variable. Similarly, when the environment state variable is the horizontal axis and the dissatisfaction level of the need informant in relation to the surrounding environment is the vertical axis, the distribution of the dissatisfaction B of "Too Cold," corresponding to a cold environment, is a monotonic distribution wherein the dissatisfaction level B increases with an increase in the coldness that is indicated by the environment state variable.

For example, an occupant who has an extreme tendency to feel too cold or an extreme tendency to feel too hot will continuously report a need for the equipment control to operate in a single direction (for example, in the direction to reduce the room temperature in the air-conditioning equipment). According to the aforementioned dissatisfaction distribution, when the reports first start, even if the report is a non-contradictory report (a persistent need), when the equipment controlling operation responds in the direction of improving the indoor environment persistently in response to the non-contradictory need report and the environment state variable changes in the direction of improvement, eventually the one-way reports will inevitably turn into contradictory reports (temporary needs). As a result, this makes it possible to avoid extreme changes in the indoor environment due to reports that are in one direction, while still achieving equipment control operations that respond to reports from the occupants.

EXAMPLES

Forms for carrying out the present disclosure will be explained below in reference to the figures. The subject of the present disclosure is an air-conditioning controlling system that applies environment change needs (such as "Too Hot," "Too Cold," "Please increase the room temperature by XX ° C.," "Please decrease the temperature by XX ° C.," or the like) to the air-conditioning for the occupants. The present disclosure applies to both a case wherein (A) the needs of the equipment administrator and the needs of the occupants are applied through a BEMS (Building and Energy Management System), or the like (including remote control of the equipment performed by a service contractor), and a case wherein (B) a reporting-type air-conditioning controlling system wherein occupants report their own needs directly, is used.

For simplicity in description, the present example will explain a case of a reporting-type air-conditioning controlling system wherein an occupant is present in a single applicable air-conditioned area (FIG. 1). In FIG. 1, 100 is an air-conditioned area, 101 is the occupant, 102 is an air-conditioning controlling device (a controller) for receiving a change need, 103 is a temperature sensor for measuring the temperature of the air-conditioned area 100, 104 is a humidity sensor for measuring the humidity of the air-conditioned area 100, 105 is indoor equipment, and 106 is outdoor equipment. The air-conditioning controlling device 102 controls the air-conditioning equipment (the indoor equipment 105 and the outdoor equipment 106) to cause the room temperature, measured by the temperature sensor 103, to match a room temperature set point, and to cause a humidity, measured by the humidity sensor 104, to match a humidity set point.

An environment state variable that indicates the state of the surrounding environment of a need informant is either a measured value itself of an environment elements such as temperature, humidity, or the like, or is a general environment indicator that is calculated using environment element measured values, such as, for example, an operative temperature, the SET* (Standard new Effective Temperature), the PMV (Predicted Mean Vote), or the like. PMV is standardized internationally in ISO-7730, and SET* is established in the American Society of Heating, Refrigerating and Air Conditioning Engineers (ASHRAE) standards. The operative temperature is also a general indicator.

The dissatisfaction level in the present disclosure is a quantity indicating the dissatisfaction level of the occupants in relation to the aforementioned environment state variable. Typically, for the dissatisfaction level, there is the dissatisfaction index or the PPD (Predicted Percentage Dissatisfied), and the like, and the methods for calculating these are publicly known. The PPD is an indicator that is calculated from the PMV.

However, the dissatisfaction level is affected also by the tastes of the occupant when it comes to the feeling of hot versus called ("too hot," or "too cold") and the type of work (the magnitude of the average amount of activity of the occupants, such as desk work, moving luggage, or the like) also has an effect. Because of this, the facilities manager or control contractor, or the like, may define a method for calculating the dissatisfaction level from the environment state variable that depends on the state of the occupants, even if other than the typical indicators, mentioned above. For example, if the temperature (room temperature) is used as the environment state variable, a V-shaped dissatisfaction distribution may be defined wherein the central value for the summertime cooling operation may be defined as 26° C., where the dissatisfaction level may be at a minimum at 26° C., and where the dissatisfaction level may reach 80% at both 24° C. and 28° C. That is, the dissatisfaction distribution should satisfy the characteristics described above. What is to be used for the environment state variable, and how the dissatisfaction is to be calculated, is determined in advance by the control contractor, the facilities manager, the energy manager, or the like.

In the present disclosure, information establishing a correlation between an occupant, an occupied space that is occupied by the occupant, an air conditioning device that is subject to control for an air-conditioning zone corresponding to that occupied space (an air-conditioning zone matching that occupied space, an air-conditioning zone that includes that occupied space, or an air-conditioning zone that is included within that occupied space), the types of environment elements, such as temperature and humidity, required for calculating an environment state variable for the occupied space, and an environment element measured value (or a memory address that stores the measured value) is stored in the need identification-type air-conditioning controlling device described below. This information may be stored in advance in the need identification-type air-conditioning controlling device, or may be inputted by a facilities manager, or the like, at the time of starting the operation of the need identification-type air-conditioning controlling device, or this information may be sent with a need that is sent by a need inputter and received by the need identification-type air-conditioning controlling device. Based on the information that is stored in this need identification-type air-conditioning controlling device the need of the occupant regarding the air-conditioning is reflected into the control of the air-conditioning equipment for the air-conditioning zone corresponding to this informant (for example, into a change of a set point).

Note that when the informant sends the need through a separate need inputter (for example, a facilities manager or an office floor environment administrator), then information that identifies the informant is also sent together with the need. As a result, the need of the informant is reflected into the control of the air-conditioning equipment corresponding to that informant. Even if there is a plurality of air-conditioning zones within a single occupied space, insofar as it is possible to identify the informant, it will be possible to identify the air-conditioning equipment corresponding to that informant, enabling the need of that informant to be reflected into control of that air-conditioning equipment. Moreover, even if there is a plurality of occupants in a single air-conditioning zone, still there is no problem insofar as the air-conditioning equipment corresponding to that informant is identified.

Furthermore, when there is a plurality of measurement points for the same environment element within a single occupied space, a memory address for storing a statistical value (such as an average value) may be produced and a statistical value that is obtained from measured values for the plurality of measurement points may be used as the environment element that is used in the calculation of the environment state variable, or a single measurement point may be established for representing the plurality of measurement points and a measured value from this measurement point may be used as the environment element used in calculating the environment state variable.

In the present disclosure, the critical point is the point that a need report is identified through evaluating the appropriateness of the need (as contradictory verses non-contradictory) depending on an environment state variable for the environment in which the need by the occupant arises, and the result of that identification is applied to the equipment operation. In the present disclosure, appropriate design changes are possible through the ordinary engineering knowledge of one skilled in the art, regardless of the air-conditioning method (for example, discrete versus central versus personal type, and so forth), the type of air-conditioning equipment used, the element controlled by air-conditioning (temperature, humidity, dissipation, or compound control thereof, or the like), and regardless of the type of terminals for inputting needs (BEMS, PCs, mobile telephones, smart phones, dedicated input terminals, and so forth), and the like.

In the present example, an explanation will be given for an example of an occupant reporting-type air-conditioning controlling system wherein the occupants themselves input (report) their own needs into the air-conditioning controlling system. The air-conditioning equipment operation in response to the need report from the occupant is an operation for changing a temperature set point. The PMV, which is an indicator indicating the thermal comfort in an occupied space, is used as an environment state variable used in determining the appropriateness (contradictory report versus non-contradictory report) of a need report, and PPD, which is also termed the Predicted Percentage Dissatisfied, is used as the dissatisfaction level.

Figure 2:
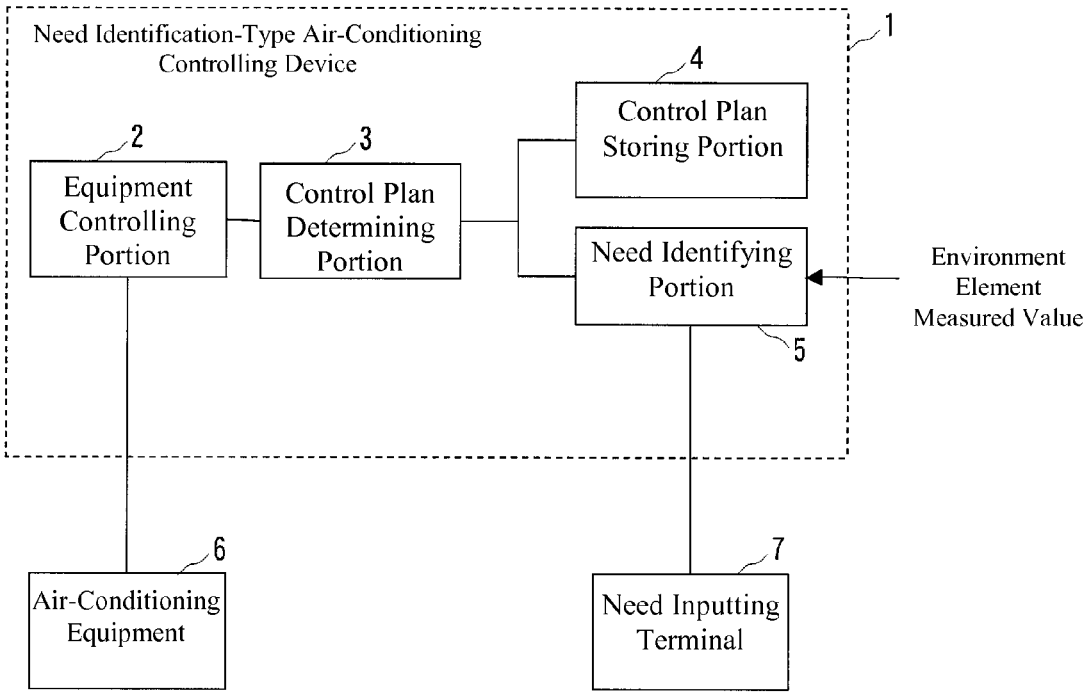
FIG. 2 is a block diagram illustrating a structure of a need identification-type air-conditioning controlling device according to an example according to the present disclosure.

FIG. 2 is a block diagram illustrating the structure of a need identification-type air-conditioning controlling device according to the present example. The need identification-type air-conditioning controlling device 1 is provided with an equipment controlling portion 2, a control plan determining portion 3, a control plan storing portion 4, and a need identifying portion 5.

The equipment controlling portion 2 controls air-conditioning equipment 6 based on the control plan established by the control plan determining portion 3.

The control plan determining portion 3 determines, from the control plan information that is stored in the control plan storing portion 4, the control plan to be applied to the air-conditioning equipment 6 based on the control plan that is in effect at the point in time of processing a need and based on the identification result by the need identifying portion 5.

Control plans that are to be applied in response to the identification results by the need identifying portion 5 are set up in advance and stored in the control plan storing portion 4. These control plans are set up in advance by a control contractor or the facilities manager.

The need identifying portion 5 evaluates the appropriateness (contradictory verses non-contradictory) of a need from an informant, to thereby identify whether a need is a temporary need or a persistent need.

The need inputting terminal 7, for informants with needs to input needs regarding the air-conditioning, may be a PC, a mobile telephone, a smart phone, a dedicated remote control terminal, or the like.

Note that although the need identification-type air-conditioning controlling device 1 is provided within the air-conditioning controlling device 102 illustrated in FIG. 1, the need identifying portion 5, as the need identifying device, may be provided outside of the air-conditioning controlling device 102.

Figure 3:
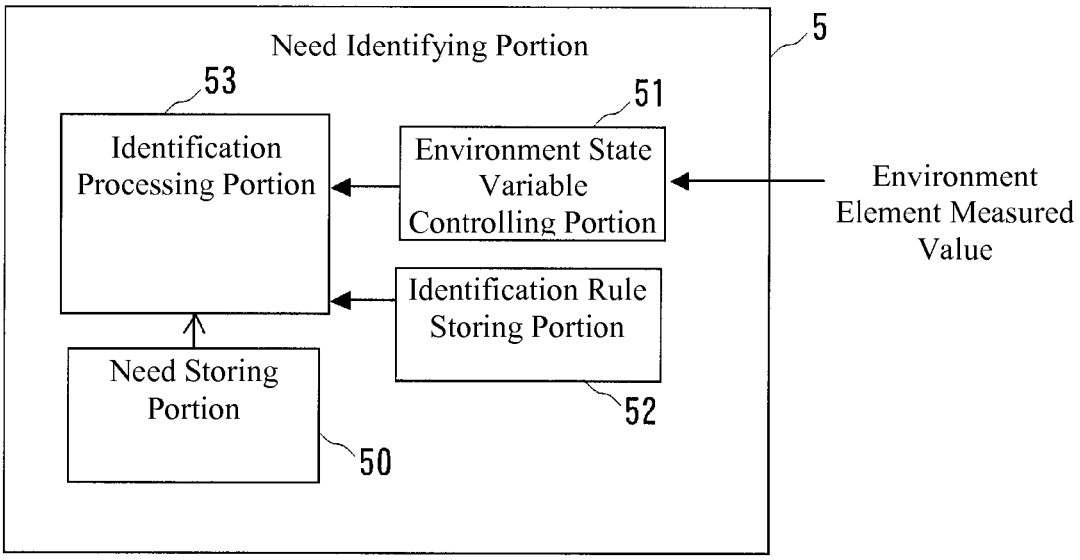
FIG. 3 is a block diagram illustrating a structure of a need identifying portion according to an example according to the present disclosure.

FIG. 3 is a block diagram illustrating the structure of the need identifying portion 5. The need identifying portion 5 is structured from a need storing portion 50, which is inputting means for receiving a need from an informant, an environment state variable controlling portion 51, an identification rule storing portion 52, and an identification processing portion 53.

The need storing portion 50 stores the need report that is inputted from the need inputting terminal 7. The environment state variable controlling portion 51 calculates an environment state variable using the environment element measured value, calculates the dissatisfaction level using the environment state variable, and sends the calculated environment state variable and dissatisfaction level to the identification processing portion 53. The methods for calculating the environment state variable and the dissatisfaction level are set in advance by the control contractor or the facilities manager.

Need identification rules for identifying needs from informants are set up in advance and stored in the identification rule storing portion 52. The need identification rules are set up by the control contractor, the facilities manager, or the energy manager.

The identification processing portion 53 evaluates the appropriateness of a need (contradicting versus non-contradicting) to identify a need as either temporary or persistent, based on the need that is stored in the need storing portion 50, the environment state variable and dissatisfaction level calculated by the environment state variable controlling portion 51, and the need identification rules stored in advance in the identification rule storing portion 52.

Figure 4:
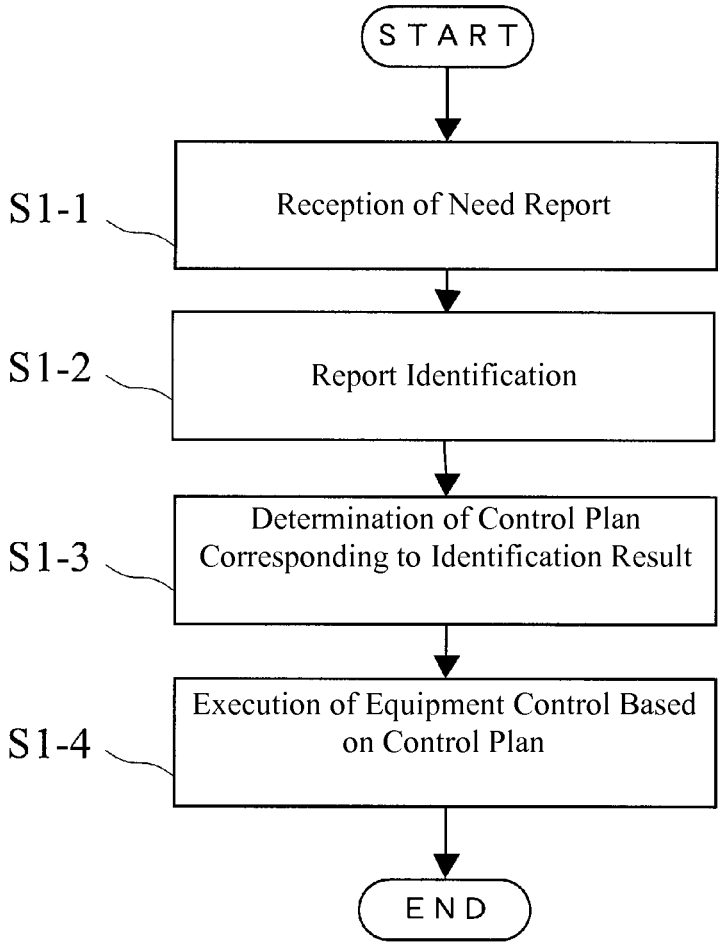
FIG. 4 is a flowchart for explaining the operation of a need identification-type air-conditioning controlling device according to an example according to the present disclosure.

The operation of the air-conditioning controlling system of the present example will be explained next. FIG. 4 is a flowchart for explaining the operation of the need identification-type air-conditioning controlling device 1 when an occupant need report has been received from a need inputting terminal 7.

The need inputting terminal 7 sends, to the need identifying portion 5, the change category DS of the need inputted by the need informant, the ZID that is information that identifies the occupied space of the need informant, and the report timing Stime thereof, and the need storing portion 50 of the need identifying portion 5 stores, as a need V(ZID, DS, Stime), the information that has been received (Step S1-1 in FIG. 4).

The need identification-type air-conditioning controlling device 1 stores the occupied space identifying information ZID of the need informant and information for associating the measurement point for the environment element required for calculating the environment state variable for the occupied space that is specified by the occupied space identifying information ZID using, for example, the environment state variable controlling portion 51. This makes it possible for the environment state variable controlling portion 51 to obtain the environment element measured value for the occupied space of the need informant based on the occupied space identifying information ZID.

In the present example, the PMV is used as the environment state variable, as described above, and the PPD is used as the dissatisfaction level. Furthermore, there are two types of environment elements used in calculating the PMV, specifically the temperature and the humidity, where the temperature measured value, which is an environment element measured value for the air-conditioned space that is specified by the occupied space identifying information ZID is defined as PV (1), and the humidity measured value which is an environment element measured value, is defined as PV (2).

In the calculation of the PMV, which is the environment state variable, along with the temperature and humidity, information for the air flow rate, the dissipation temperature, the amount of clothing worn, and the amount of activity is required. For the information other than the temperature and humidity, constant values may be set in advance in the environment state variable controlling portion 51 in consideration of the applicable building, occupants, time of the year, and the like. The PPD can be calculated from the PMV. The methods for calculating PMV and PPD follow the calculation methods that are standardized internationally.

Moreover, in the present example it is assumed that there are only two possible change categories DS that can be selected by the need informant, "Too Hot" and "Too Cold," where "Too Hot" is indicated by the value "1," and "Too Cold" is indicated by the value "−1." That is, a need reported by the occupant of the occupied space that is identified by ZID=55 as "Too Hot" with a report time of 10:10 a.m. would be stored as V(55, 1, 10:10), and a need reported as "Too Cold" at that same time would be stored as V(55, −1, 10:10).

Note that while in this example the occupied space identifying information ZID, the change category DS, and the report time Stime are sent from the need inputting terminal 7, the report time Stime need not necessarily be sent from the need inputting terminal 7, but instead the report time Stime may be added by the need storing portion 50 using, for the report time, the time at which the need report is received.

Figure 5:
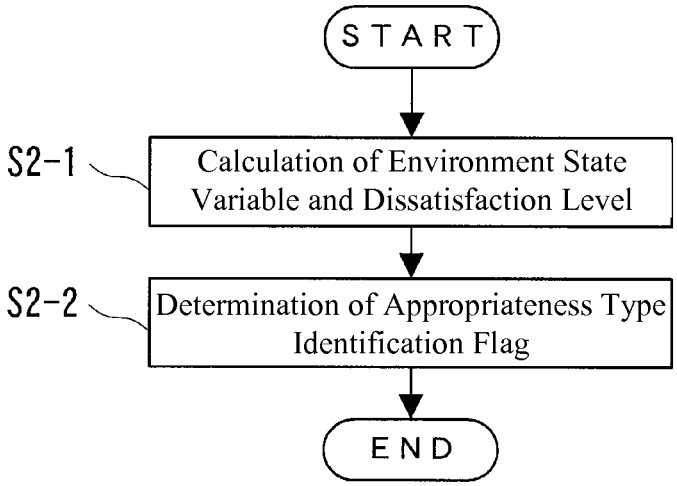
FIG. 5 is a flowchart for explaining the operation of a need identifying portion according to an example according to the present disclosure.

When a need V(ZID, DS, Stime) is received from the need inputting terminal 7 (Step S1-1), the identification processing portion 53 of the need identifying portion 5 performs report identification (FIG. 4, Step S1-2) by evaluating the appropriateness of the need V(ZID, DS, Stime) based on the need identification rules set up in advance in the identification rule storing portion 52. FIG. 5 is a flowchart for explaining the operation of the need identifying portion 5 in Step S1-2.

First, the environment state variable controlling portion 51 of the need identifying portion 5 obtains the environment element measured values PV (1) and PV (2) corresponding to the occupied space by the need informant, based on the occupied space identifying information ZID and on the report submission time Stime that are included in the need V(ZID, DS, Stime), calculates the PMV (ZID, Stime), which is the environment state variable, based on PV (1) and PV (2), and calculates the PPD (ZID, Stime), which is the dissatisfaction level, from the PMV (FIG. 5, Step S2-1). The environment state variable controlling portion 51 is provided with an environment state variable calculating portion (not shown) and a dissatisfaction deriving portion (not shown).

The environment state variable controlling portion 51 collects periodically all of the environment element measured values that can be collected, and stores in a database (not shown) the collected environment element measured values, in association with the occupied space identifying information ZID, the type of environment element, and the collection date and time. Following this, when a need V(ZID, DS, Stime) has been received, the environment state variable controlling portion 51 may obtain, from the database, the environment element measured values PV (1) and PV (2) that were collected near to the need submission time Stime of the need V(ZID, DS, Stime), from among the environment element measured values corresponding to the occupied space identifying information ZID included in the need V(ZID, DS, Stime). Conversely, when a need V(ZID, DS, Stime) has been received, the environment state variable controlling portion 51 may obtain, from the measurement points, environment element measured values PV (1) and PV (2) corresponding to the occupied space identifying information ZID that is included in the need V(ZID, DS, Stime).

Given this, an environment state variable calculating portion (not shown) of the environment state variable controlling portion 51 calculates the PMV (ZID, Stime) using the environment element measured values PV (1) and PV (2) that have been obtained, along with the constant values that have been set in advance for the air flow rate, the dissipation temperature, the amount of clothing worn, and the amount of activity, which are the parameters for calculating the PMV.

In the present example, the PPD, which is used as the dissatisfaction level, is an indicator that is correlated with the PMV, and is calculated using Equation (1), below. The dissatisfaction level deriving portion (not shown) of the environment state variable controlling portion 51 can calculate the PPD (ZID, Stime) using Equation (1).

$$PPD=100\times 95\exp\{-(0.03353\times(PMV)\hat{}4+0.2179\times(PMV)\hat{}2)\} \quad (1)$$

Figure 6:
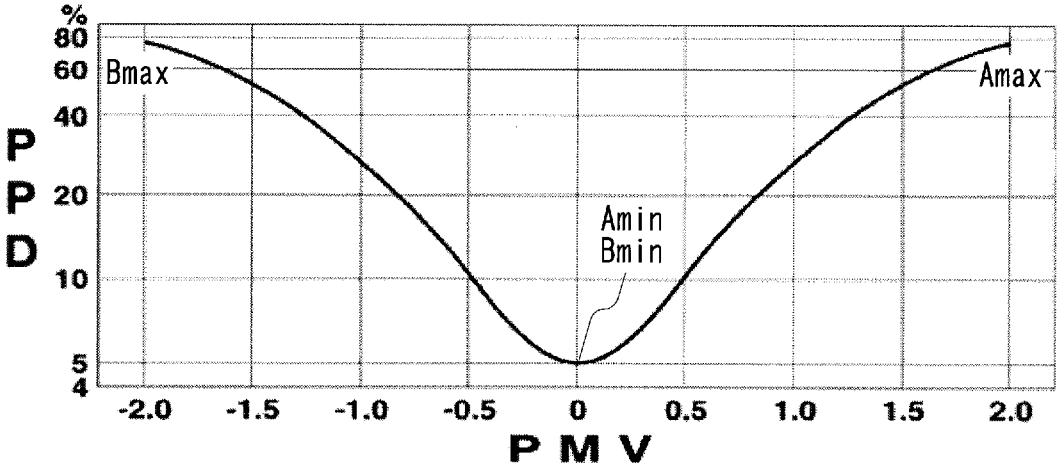
FIG. 6 is a diagram illustrating the relationship between the PMV, which is an environment state variable, and the PPD, which is the dissatisfaction level.

With the horizontal axis as the PMV, which is the environment state variable, and the vertical axis as the PPD, which is the dissatisfaction level, the relationship between the PMV and the PPD is as shown in FIG. 6. PMV=0 indicates that it is neither too hot nor too cold where PMV=1 indicates that it is somewhat too hot, and PMV=2 indicates that it is too hot. Moreover, PMV=−1 indicates that it is somewhat too cold, and PMV=−2 indicates that it is too cold. Moreover, the greater the numeric value of PPD, the greater the dissatisfaction level that is indicated.

As described above, the distribution of the dissatisfaction level A corresponding to the "Too Hot" thermal environment is a monotonic distribution wherein the dissatisfaction level A increases as the hotness indicated by the environment state variable increases. In the example in FIG. 6, there is a maximum value Amax for the dissatisfaction level A on the positive side of PMV (which, in the example in FIG. 6, is about 78%), where, at PMV=0 the dissatisfaction level A is the minimum value Amin (which, in the example in FIG. 6, is about 5%), where there is a monotonic distribution from the minimum value Amin to the maximum value Amax.

Similarly, the distribution of the dissatisfaction level B corresponding to the "Too Cold" thermal environment is a monotonic distribution wherein the dissatisfaction level B increases as the coldness indicated by the environment state variable increases. In the example in FIG. 6, there is a maximum value Bmax for the dissatisfaction level B on the negative side of PMV (which, in the example in FIG. 6, is about 78%), where, at PMV=0 the dissatisfaction level B is the minimum value Bmin (which, in the example in FIG. 6, is about 5%), where there is a monotonic distribution from the minimum value Bmin to the maximum value Bmax.

Need identification rules for identifying a need V(ZID, DS, Stime) are set up in advance by the control contractor or the facilities manager, or the like, in the identification rule storing portion 52 of the need identifying portion 5 based on the PMV, which is the environment state variable, the PPD, which indicates the dissatisfaction level, and the type of change DS in the need V(ZID, DS, Stime). In the present example, an example of a rule for evaluating the appropriateness of a need by establishing, for each type of change DS, an identification threshold value (hereinafter termed "a threshold value") Hth (DS), and then comparing the PPD (ZID, Stime) to the threshold value Hth (DS).

Here the threshold value for a need wherein the change category DS=1, that is, for a need V(ZID, 1, Stime) that is "Too Hot," is Hth (1), and the threshold value for a need wherein the change category DS=−1, that is, for a need V(ZID, −1, Stime) that is "Too Cold," is Hth (−1).

The identification processing portion 53 of the need identifying portion 5 compares the PPD (ZID, Stime), calculated by the environment state variable controlling portion 51, to the threshold value Hth (DS) that is set in advance in the need identification rules of the identification rule storing portion 52, to determine an appropriateness identification flag Fd (hereinafter termed the "identification flag) that indicates the appropriateness of the need V(ZID, DS, Stime) (FIG. 5, Step S2-2). Specifically, when PPD (ZID, Stime)>Hth (DS), that is, when PPD (ZID, Stime) is greater than the threshold value Hth (DS), then the identification processing portion 53 sets the identification flag Fd to 1, and when PPD (ZID, Stime)≤Hth (DS), that is, when PPD (ZID, Stime) no greater than the threshold value Hth (DS), then the identification processing portion 53 sets the identification flag Fd to 0.

The identification flag Fd=1 indicates that the need V(ZID, DS, Stime) is a non-contradictory report, so is a persistent need, and the identification flag Fd=0 indicates that the need V(ZID, DS, Stime) is a contradictory report, so is a temporary need.

In this way, for an environment wherein there is the need V(ZID, 1, Stime) that is "Too Hot," if the PPD (ZID, Stime) that is calculated from the environment state value is greater than the threshold value Hth (1), then the appropriateness of the need report is high, and the need V(ZID, 1, Stime) is a non-contradictory report, so is identified by the identification processing portion 53 to be a persistent need, where if PPD (ZID, Stime) is equal to or less than the threshold value Hth (1), then the appropriateness of the need report is low, and the need V(ZID, 1, Stime) is a contradictory report, so the identification is that it is a temporary need.

Moreover, for an environment wherein there is the need V(ZID, −1, Stime) that is "Too Cold," if the PPD (ZID, Stime) that is calculated from the environment state value is greater than the threshold value Hth (−1), then the appropriateness of the need report is high, and the need V(ZID, −1, Stime) is a non-contradictory report, so is identified by the identification processing portion 53 to be a persistent need, where if PPD (ZID, Stime) is equal to or less than the threshold value Hth (−1), then the appropriateness of the need report is low, and the need V(ZID, −1, Stime) is a contradictory report, so the identification is that it is a temporary need.

Figure 7:
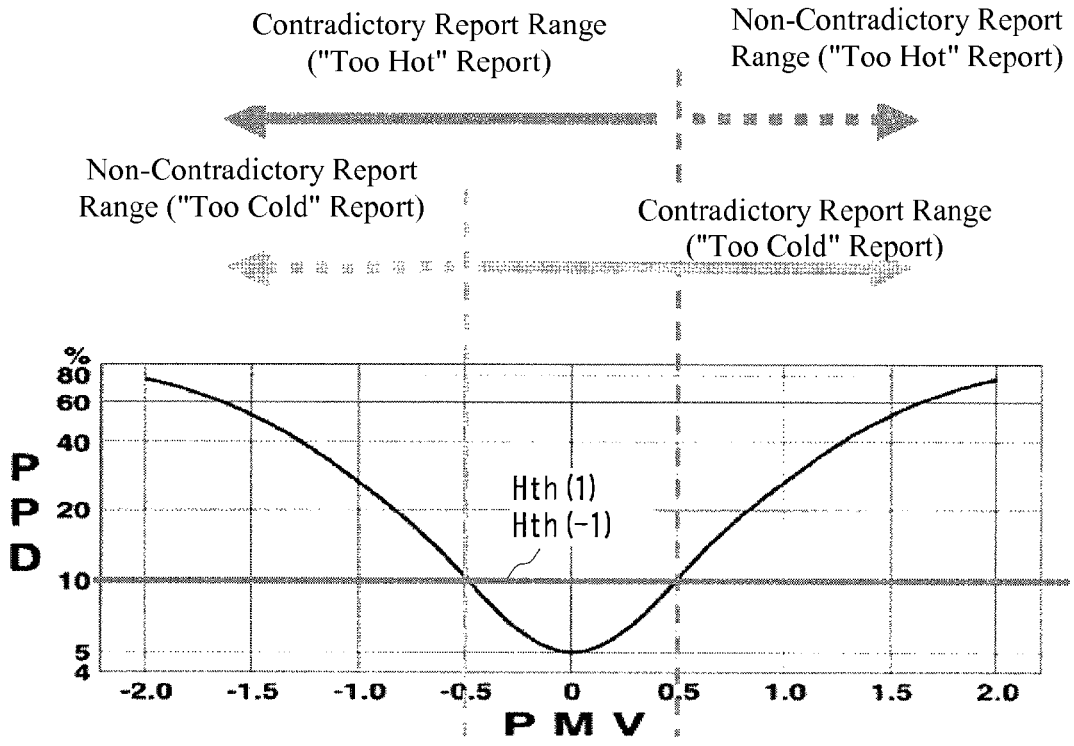
FIG. 7 is a diagram illustrating an example of operation of an identifying processing portion of a need identifying portion according to an example according to the present disclosure.
Figure 8:
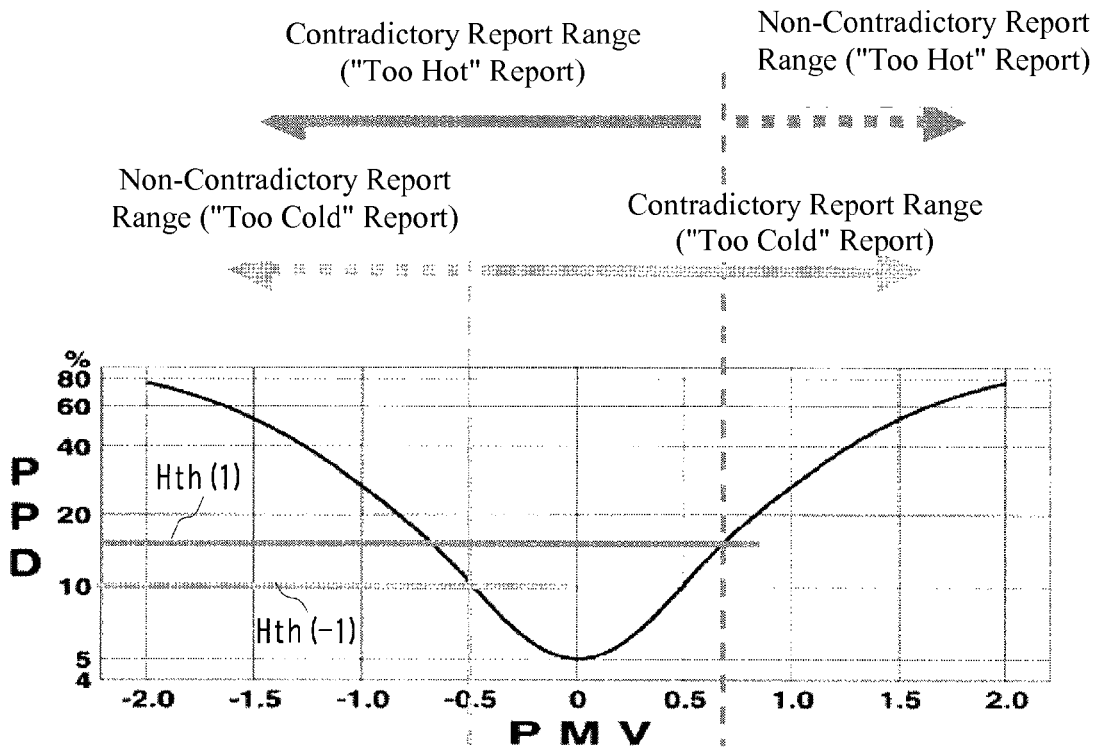
FIG. 8 is a diagram illustrating an example of operation of another identifying processing portion of a need identifying portion according to an example according to the present disclosure.

The ranges wherein V(ZID, 1, Stime) and V(ZID, −1, Stime) are identified as contradictory reports (temporary needs) and the range wherein they are non-contradictory reports (persistent needs), in the case of Hth (1)=Hth (−1) =10%, are shown in FIG. 7. Note that while in FIG. 7 the threshold values Hth (1) and Hth (−1) have identical values, if the threshold value Hth (1) for the need V(ZID, 1, Stime) that is "Too Hot" is set to be large and the threshold value Hth (−1) for the need V(ZID, −1, Stime) that is "Too Cold" is set to be small, then it will be possible to operate in such a way as to emphasize energy conservation when cooling during the summer. The ranges wherein V(ZID, 1, Stime) and V(ZID, −1, Stime) are identified as contradictory reports (temporary needs) and the range wherein they are non-contradictory reports (persistent needs), in the case of Hth (1)=15% and Hth (−1)=10%, are shown in FIG. 8.

The identification processing portion 53 links a need change category DS and the identification flag Fd with the need V(ZID, DS, Stime) that has been received from the need inputting terminal 7, and stores these as a need status DC(DS, Fd). Step S1-2 in FIG. 4 is completed thereby.

Following this, the control plan determining portion 3 determines a control plan corresponding to the need V(ZID, DS, Stime) being processed (Step S1-3 in FIG. 4). The control plan determining portion 3 uses the control plan that is in effect at the current point in time in the air-conditioning equipment 6 (hereinafter termed the "current control plan), the control plans that have been set in advance in the control plan storing portion 4, and the need state DC (DS, Fd) that is stored in the need identifying portion 5 to determine the control plan to be applied next to the air-conditioning equipment 6.

Figure 9:
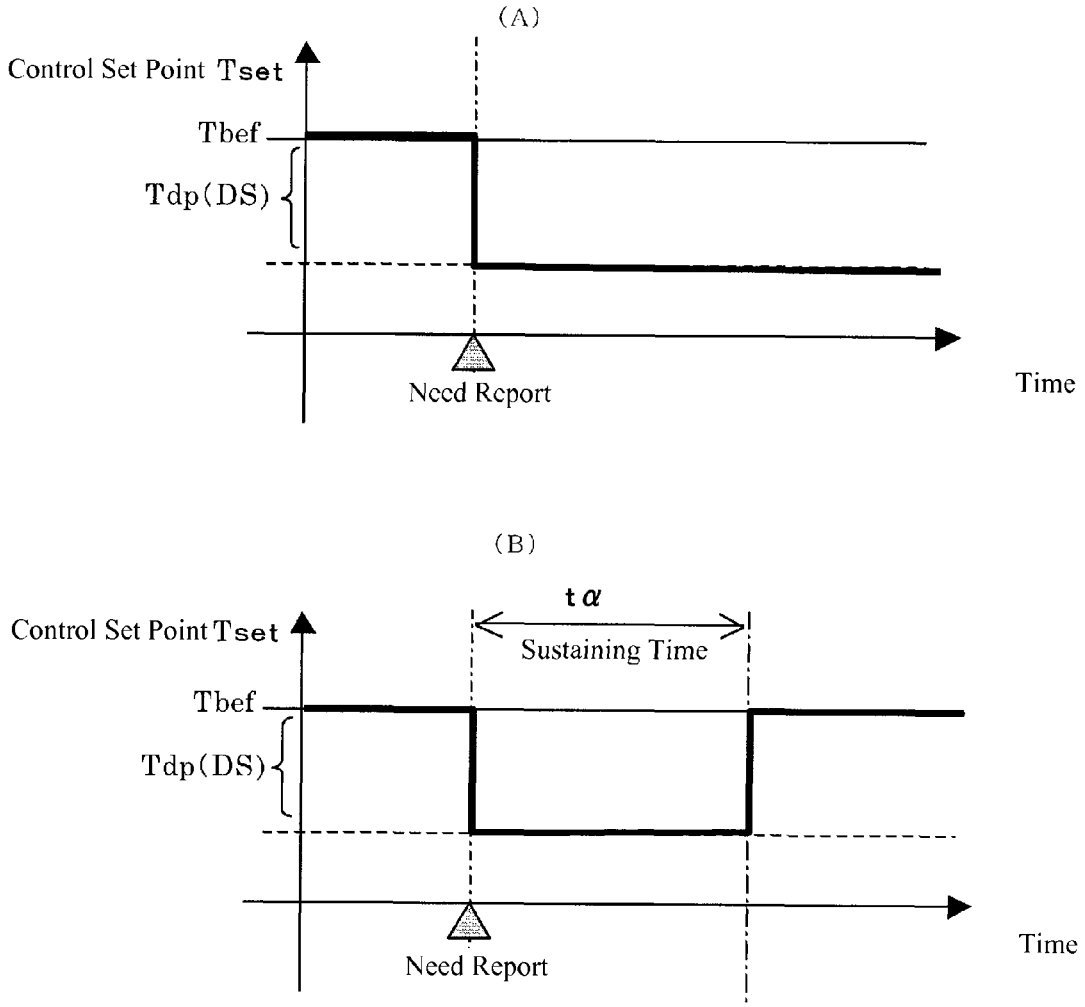
FIG. 9 is a diagram for explaining a control plan according to an example according to the present disclosure.

Control plans corresponding to temporary needs and to persistent needs are each set up in the control plan storing portion 4. Conventional general-use control plans (conventional control plans that are executed in accordance with the change category, without identifying the appropriateness of the need) may be established as the control plans corresponding to persistent needs (control plans corresponding to Fd=0). For simplicity in the explanation, in the present example a control plan wherein the control set point Tset=Tbef at the point in time of processing the need V(ZID, DS, Stime) is changed depending on the change category DS of the need V(ZID, DS, Stime), as illustrated in FIG. 9 (A) is used as the control plan corresponding to a persistent need. The change in the control set point Tset through this control plan can be expressed by the following expression:

$$Tset=Tbef+Tdp(DS) \quad (2)$$

The temperature set point is an example of a control set point Tset. The Tdp(DS) in Expression (2) is the magnitude of the change in the set point. This set point change magnitude Tdp(DS) is determined by the following equation:

$$Tdp(DS)=S(DS)\times\gamma dp(DS) \quad (3)$$

As described above, when the need informant reports "Too Hot," the change category DS will be set to 1, and when the need informant reports "Too Cold," the change category DS will be set to −1. The S(DS) in Expression (3) is a coefficient indicating the direction of the change (increase vs. decrease) in the control set point Tset corresponding to the change category DS. When the change category DS=1, the coefficient S(1)=−1, and when the change category DS=−1, the coefficient S(−1)=1. In other words, when the need informant reports "Too Hot," the coefficient S(DS) is set to −1, and the control set point Tset is lowered, and if the need informant reports "Too Cold," then the coefficient S(DS) is set to 1, and the control set point Tset is increased.

The γdp(DS) in Expression (3) is the set point change magnitude corresponding to the change category DS. This set point change magnitude γdp(DS) is determined in advance by the control contractor, the facilities manager, or the like, depending on the change category DS. Here the set point change magnitude γdp(DS) is defined uniformly as 0.5° C. regardless of the value of the change category DS, but, of course, it may instead be given values that vary depending on the value of the change category DS.

On the other hand, a control plan wherein, for example, the control set point Tset is changed in the same way as for the control plan corresponding to a persistent need but then, after the change in the set point has been sustained for a sustaining time tα, the control set point Tset is returned to Tset=Tbef from before responding to the reported need, may be set up as a control plan corresponding to a temporary need (a control plan corresponding to Fd=0) (FIG. 9 (B)). The changes in the control set point Tset are as have been explained using Expression (2) and Expression (3). The sustaining time tα is the time that is set for a need for which the appropriateness is low, and should be set to, for example, 10 minutes. This sustaining time to may be set appropriately by the facilities manager, or the like, depending on operating conditions.

Finally, the equipment controlling portion 2 controls the air-conditioning equipment 6 based on the new control planned that has been determined by the control plan determining portion 3 (Step S1-4 in FIG. 4). That is, the equipment controlling portion 2 sets the new control set point Tset to be applied to the air-conditioning equipment 6 based on the current control set point Tset=Tbef that is applied to the air-conditioning equipment 6 at the point in time of processing the need V(ZID, DS, Stime), the change category DS of the need V(ZID, DS, Stime), and the control plan determined by the control plan determining portion 3. Moreover, the equipment controlling portion 2 controls of the air-conditioning equipment 6 so that the control variable of the air conditioner (for example, the room temperature) will match the control set point Tset (for example, a room temperature set point). PID, for example, is well known as a control algorithm.

The processes in Step S1-1 through S1-4 are repeated for the need each time the need informant issues a new need.

Figure 10:
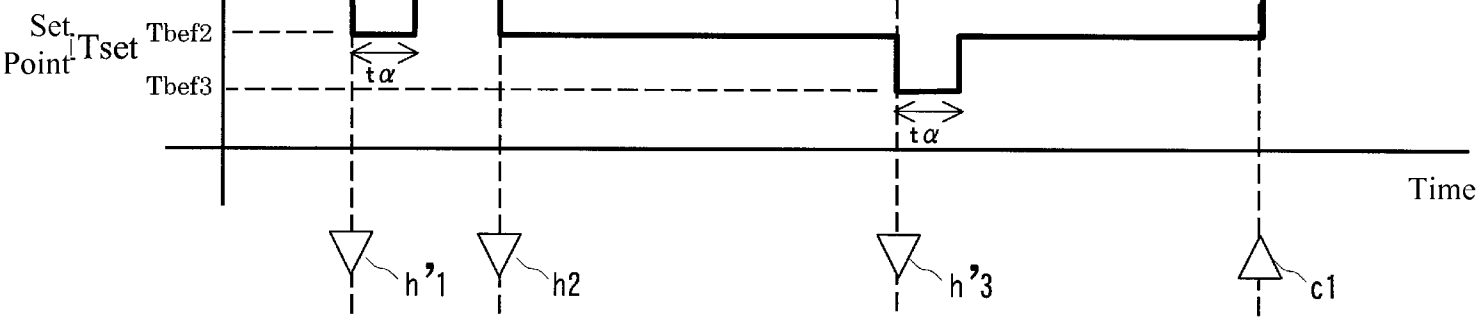
FIG. 10 is a diagram illustrating an alternate example a control set point controlling device in response to a reported need, according to an example according to the present disclosure.

FIG. 10 illustrates one example of how the control set point Tset is changed in response to a need report. In FIG. 10, h'1 and h'3 indicate "Too Hot" temporary needs, h2 indicates a "Too Hot" persistent need, and c1 indicates a "Too Cold" persistent need.

When, at a time t1, the "Too Hot" temporary need h'1 is produced, the control plan determining portion 3 determines a control plan for responding to a temporary need as the new control plan to be applied to the air-conditioning equipment 6. The equipment controlling portion 2, based on this control plan, reduces the control set point Tset to Tbef2 in accordance with Expression (2) and Expression (3), and then, after the sustaining time tα (which is 10 minutes in the present example), restores the control set point Tset to Tbef1 from before time t1.

Next, at a time t2, the "Too Hot" persistent need h2 is produced, the control plan determining portion 3 determines a control plan for responding to a persistent need as the new control plan to be applied to the air-conditioning equipment 6. The equipment controlling portion 2, based on this control plan, reduces the control set point Tset to Tbef2 in accordance with Expression (2) and Expression (3).

Following this, at a time t3, the "Too Hot" temporary need h'3 is produced, and the control plan determining portion 3 determines a control plan for responding to a temporary need as the new control plan to be applied to the air-conditioning equipment 6. The equipment controlling portion 2, based on this control plan, reduces the control set point Tset to Tbef3, and then, after the sustaining time tα, restores the control set point Tset to Tbef2 from before time t3.

Next, at a time t4, the "Too Cold" persistent need c1 is produced, the control plan determining portion 3 determines a control plan for responding to a persistent need as the new control plan to be applied to the air-conditioning equipment 6. The equipment controlling portion 2, based on this control plan, increases the control set point Tset to Tbef1.

As in the above, in the present example the environment state variable that indicates the state of the surrounding environment for the informant is calculated and the dissatisfaction level is estimated from the environment state variable, to identify, based on the dissatisfaction level, whether a need from an informant is a temporary need or is a persistent need. In the present example, doing so makes it possible to sustain the improved environment through continuing the equipment controlling operation in response to this need when the need from the informant is identified as a persistent need, and to execute a temporary improvement in the environment through performing the equipment controlling operation for the need only temporarily when the need from the informant is identified as a temporary need.

At this time, the dissatisfaction distribution when the environment state variable takes the horizontal axis and the dissatisfaction level takes the vertical axis follows the characteristics described above, and thus when there are continual need reports from a specific individual that would cause the equipment control operation to operate toward one side (for example, to the side of reducing the temperature in air-conditioning equipment), the environment will be improved in a sustained manner as long as the needs are identified as non-contradictory reports, but as the environment is improved, the appropriateness of need reports further in the same direction is reduced, so that eventually they will turn into contradictory reports. Given this, if they turn into contradictory reports, then the equipment control operation will become temporary, making it possible to reduce the likelihood of extreme movements in the indoor environment.

Through the above, in the present example it is possible to prevent unnecessary increases in energy consumption, and possible to not only improve reliably the indoor environment when there is a strong need to improve the indoor environment, as well as it being possible to avoid extreme movements in the indoor environment through continual reports by a specific individual.

While in the present example the environment state variable controlling portion 51 calculated the PPD, which is the dissatisfaction level, from the PMV, which is an environment state variable, there is no limitation thereto, but instead the dissatisfaction level may be calculated from the environment state variable based on a relationship, established in advance, between the environment state variable and the dissatisfaction level. That is, as illustrated in FIG. 6, if a dissatisfaction distribution curve is recorded in the environment state variable controlling portion 51, then the dissatisfaction level deriving portion (not shown) of the environment state variable controlling portion 51 can calculate the PPD, which is the dissatisfaction level, from the PMV, which is the environment state variable.

It is not necessary to record all of the dissatisfaction distribution curves themselves, but rather if the relationship between the environment state variable and the dissatisfaction level is clearly defined, then all that is necessary is to record, in the environment state variable controlling portion 51, a point, in the dissatisfaction distribution, to form a representative feature that is required for identifying a need. That is, in, for example, FIG. 8, if information in the vicinity of the threshold values Hth (1) and Hth (−1) is recorded, then it will be possible to produce the processes for identifying the needs in the present example.

Moreover, while in the control in the present example the sustaining time to was a constant, the sustaining time to may instead be changed so as to be shorter the longer the distance between the point that corresponds to the threshold value when identifying the appropriateness of a need (the intersections between the threshold values Hth (1) and Hth (−1) and the dissatisfaction distribution curve in FIG. 8) and the value of the PPD that is calculated by the environment state variable controlling portion 51.

Figure 11:
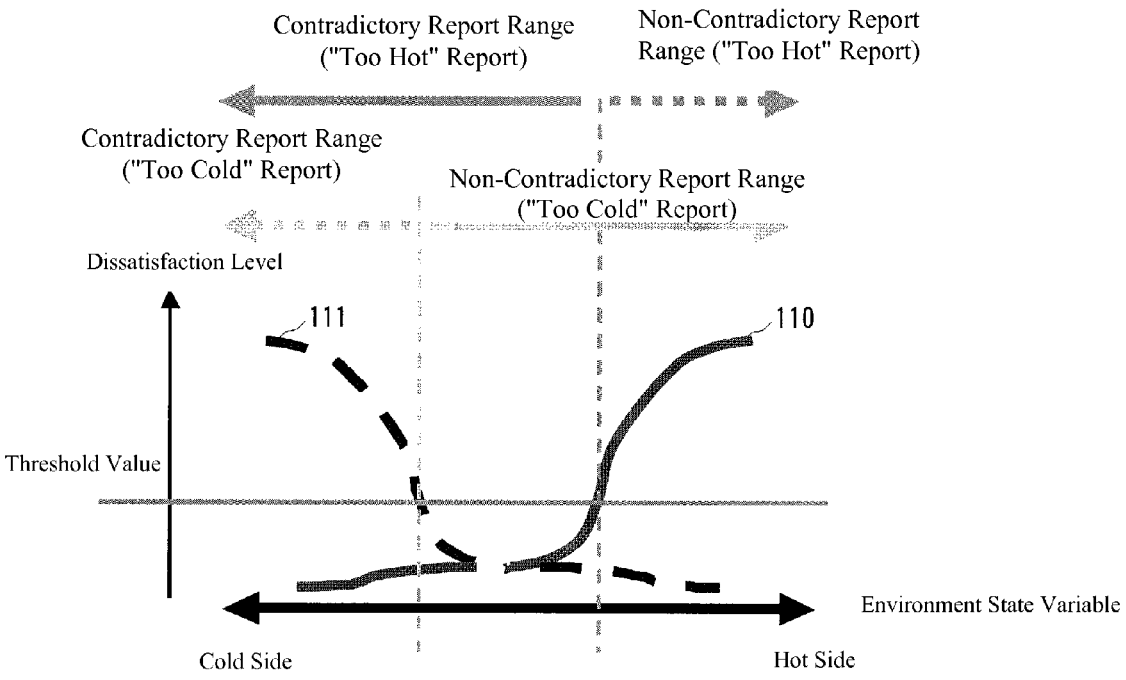
FIG. 11 is a diagram illustrating another example of the dissatisfaction distribution.

Note that PMV>0 indicates a "Too Hot" environment, and PMV<0 indicates a "Too Cold" environment. Consequently, the dissatisfaction level indicated on the PMV>0 side is a dissatisfaction level in relation to "Too Hot," and the dissatisfaction level regarding "Too Cold" will not be larger than the minimum value for the dissatisfaction level at PMV=0. That is, this means that the magnitude relationship between the dissatisfaction level for "Too Hot" and the dissatisfaction level for "Too Cold" on the PMV>0 side is "Too Hot">"Too Cold." Similarly, the dissatisfaction level indicated on the PMV<0 side is a dissatisfaction level in relation to "Too Cold," and the dissatisfaction level regarding "Too Hot" will not be larger than the minimum value for the dissatisfaction level at PMV=0. That is, this means that the magnitude relationship between the dissatisfaction level for "Too Hot" and the dissatisfaction level for "Too Cold" on the PMV<0 side is "Too Hot"<"Too Cold." Note that because, in practice, there are differences between the perceptions of different individuals, cases wherein there is a clear mixture of "Too Hot" needs and "Too Cold" needs at the same value for the environment state variable are not uncommon. Examples of the dissatisfaction distribution that is set in the case wherein such cases are considered are illustrated in FIG. 11. For the "Too Hot" needs, the dissatisfaction distribution indicated by 110 in FIG. 11 should be used, and for the "Too Cold" needs, the dissatisfaction distribution indicated by 111 in FIG. 11 should be used. Doing so makes it possible to achieve operation equivalent to that illustrated in FIG. 8.

Furthermore, when, in the summer time or the wintertime, or the like, dissatisfaction is anticipated on either the "Too Hot" side or the "Too Cold" side alone, then the system may be such that only the dissatisfaction distribution corresponding to the anticipated side, from among the dissatisfaction distributions 110 and 111 that are illustrated in FIG. 11, need be used.

Given the above, the features in FIG. 8 and FIG. 11 can be summarized as follows: (1) The dissatisfaction level A in a case wherein an informant feels too hot has a maximum value Amax for the dissatisfaction level A at the end value side X1 in one direction on the horizontal axis and has a minimum value Amin for the dissatisfaction level A at the end value side X2 in the opposite direction from the end value side X1 on the horizontal axis, and there is a monotonic distribution from the minimum value Amin to the maximum value Amax.

(2) The dissatisfaction level B in a case wherein an informant feels too cold has a minimum value Bmin for the dissatisfaction level B at the end value side X1 in one direction on the horizontal axis, the side wherein the dissatisfaction level A is at a maximum value, and has a maximum value Bmax for the dissatisfaction level B at the end value side X2 in the opposite direction from the side wherein the dissatisfaction level A has its minimum value on the horizontal axis, and there is a monotonic distribution from the minimum value Bmin to the maximum value Bmax.

(3) Between the minimum value Amin and the maximum value Amax, or the minimum value Bmin and the maximum value Bmax, the magnitude relationships between the dissatisfaction levels A and the dissatisfaction levels B have distributions with opposite relationships.

(4) As the characteristics that combine the dissatisfaction levels A and dissatisfaction levels B there is a dissatisfaction distribution that has a minimum value near the center, wherein the numeric value rises toward the left and toward the right.

Consequently, the dissatisfaction level deriving portion (not shown) of the environment state variable controlling portion 51, when estimating the dissatisfaction level in accordance with an environment state variable, may calculate the dissatisfaction level A if the informant feels too hot and calculate the dissatisfaction level B if the informant feels too cold, and the identification processing portion 53 may identify as a temporary need a need wherein there is a report of being too cold when the dissatisfaction level A is larger than the dissatisfaction level B, or when there is a report of being too hot when the dissatisfaction level A is smaller than the dissatisfaction level B, and should identify other needs as persistent needs.

The dissatisfaction level deriving portion may calculate the dissatisfaction level A when the informant feels too hot and the dissatisfaction level B when the informant feels too cold, using two different formulas that are established individually for each, to calculate the environment state variables individually. Conversely, the dissatisfaction level deriving portion may calculate the dissatisfaction level A depending on an environment state variable from a specific dissatisfaction distribution corresponding to a "Too Hot" need (110 in FIG. 11) and may calculate the dissatisfaction level B depending on an environment state variable from a specific dissatisfaction distribution corresponding to a "Too Cold" need (111 in FIG. 11).

Moreover, the identification processing portion 53 may identify, as a temporary need, a need reported by an informant as being too cold when an environment state variable changes to the side wherein the informant feels too hot and the rate of change of the dissatisfaction level A per unit time interval is no less than a specific first value, or may identify, as a temporary need, a need reported by an informant as being too hot when an environment state variable changes to the side wherein the informant feels too cold and the rate of change of the dissatisfaction level B per unit time interval is no less than a specific second value, and may identify other needs as persistent needs. For example, if, in FIG. 11, the rate of change of the dissatisfaction level A, calculated from the dissatisfaction distribution of 110, is no less than the specific first value while there is a change in the environment state variable toward the hot side and there is a "Too Cold" need from the informant, this need is identified as a temporary need. Moreover, if the rate of change of the dissatisfaction level B, calculated from the dissatisfaction distribution of 111, is no less than the specific second value while there is a change in the environment state variable toward the cold side and there is a "Too Hot" need from the informant, this need is identified as a temporary need. The first value and the second value may be either identical values or different values. As described above, the dissatisfaction deriving portion may calculate the dissatisfaction levels A and B, or may instead find the dissatisfaction levels A and B from dissatisfaction distributions that are stored in advance (110 and 111 in FIG. 11).

Note that in the processes that are actually executed, identical processes are performed if either the dissatisfaction level A, corresponding to "Too Hot" or the dissatisfaction level B, corresponding to "Too Cold" is used to evaluate a numeric value for the dissatisfaction level. Moreover, the dissatisfaction distribution that is recorded in advance need not be for all dissatisfaction levels A in dissatisfaction levels B, but rather may be for portions thereof that form typical features.

The need identification-type air-conditioning controlling device 1 explained in the present example may be embodied through a computer that is equipped with a CPU, a storage device, and an interface, combined with a program for controlling these hardware resources. The CPU executes the processes described in the present example in accordance with a program that is stored in the storage device.

The present disclosure can be applied to technologies for reflecting, into equipment control, needs pertaining to the surrounding environment from informants.

The invention claimed is:

1. A need identifying device comprising:

an inputting portion that receives, from an informant, a need pertaining to air-conditioning a surrounding environment;

an environment state variable calculating portion that calculates an environment state variable for indicating the state of the surrounding thermal environment of a space occupied by the informant based on an environment element measured value collected from the space occupied by the informant;

a dissatisfaction level deriving portion that calculates a first and second dissatisfaction level regarding the surrounding thermal environment of the informant based on the environment state variable;

an identification processing portion that identifies the need from the informant as a temporary need or as a persistent need based on the dissatisfaction level; wherein when calculating the dissatisfaction level in accordance with the state of the thermal environment, indicated by the environment state variable, the dissatisfaction level deriving portion calculates the first dissatisfaction level corresponding to occupants in the surrounding environment feeling too hot and the second dissatisfaction level corresponding to the occupants feeling too cold; and the identification processing portion identifies the need reported by the informant as a temporary need if:

the need from the informant indicates the informant is too cold when the first dissatisfaction level is greater than the second dissatisfaction level or the need reported by the informant indicates the informant is too hot when the first dissatisfaction level is less than the second dissatisfaction level, and identifies other needs as persistent needs; and a control plan determining portion that establishes, in response to a temporary need being identified, that a control setting value of the device will change in accordance with the need from the informant, and that the control setting value will be returned to a value from prior to the change after a specific sustaining time has elapsed; and in response to a persistent need being identified, establishes that the control setting value will be changed on a persistent basis in accordance with the need from the informant.

2. A need identifying device comprising:

an inputting portion that receives, from an informant, a need pertaining to air-conditioning a surrounding environment;

an environment state variable calculating portion that calculates an environment state variable for indicating the state of the surrounding thermal environment of a space occupied by the informant based on an environment element measured value collected from the space occupied by the informant;

a dissatisfaction level deriving portion that calculates a first and second dissatisfaction level regarding the surrounding thermal environment of the informant based on the environment state variable;

an identification processing portion that identifies the need from the informant as a temporary need or as a persistent need based on the dissatisfaction level; wherein when calculating the dissatisfaction level in accordance with the state of the thermal environment, indicated by the environment state variable, the dissatisfaction level deriving portion calculates the first dissatisfaction level corresponding to occupants in the surrounding environment feeling too hot and the second dissatisfaction level corresponding to the occupants feeling too cold; and the identification processing portion identifies the need reported by the informant as a temporary need if:

the need from the informant indicates the informant is too cold when the environmental state variable corresponds to occupants feeling too hot or the need reported by the informant indicates the informant is too hot when the environment sate variable corresponds to occupants feeling too cold, and identifies other needs as persistent needs; and a control plan determining portion that establishes, in response to a temporary need being identified, that a control setting value of the device will change in accordance with the need from the informant, and that the control setting value will be returned to a value from prior to the change after a specific sustaining time has elapsed; and in response to a persistent need being identified, establishes that the control setting value will be changed on a persistent basis in accordance with the need from the informant.

3. A need identifying method, comprising:

an inputting step that receives, from an informant, a need pertaining to air-conditioning a surrounding environment, an environment state variable calculating step that calculates, via a processor, an environment state variable for indicating the state of the surrounding thermal environment of a space occupied by the informant, based on an environment element measured value collected from the space occupied by the informant;

a dissatisfaction level deriving step that calculates, via the processor, a first and second dissatisfaction level regarding the surrounding thermal environment of the informant based on the environment state variable, an identifying step that identifies, via the processor, the need from the informant as a temporary need or as a persistent need based on the dissatisfaction level, wherein the dissatisfaction level deriving step includes a step that calculates the first dissatisfaction level corresponding to occupants in the surrounding environment feeling too hot and the second dissatisfaction level corresponding to the occupants feeling too cold; and the identifying step includes a step that identifies the need reported by the informant as a temporary need if:

the need from the informant indicates the informant is too cold when the first dissatisfaction level is greater than the second dissatisfaction level or the need reported by the informant indicates the informant is too hot when the first dissatisfaction level is less than the second dissatisfaction level, and identifies other needs as persistent needs; and a control plan determining step that establishes, in response to a temporary need being identified, that a control setting value of the device will change in accordance with the need from the informant, and that the control setting value will be returned to a value from prior to the change after a specific sustaining time has elapsed ; and in response to a persistent need being identified, establishes that the control setting value will be changed on a persistent basis in accordance with the need from the informant.

4. A need identifying method, comprising:

an inputting step that receives, from an informant, a need pertaining to air-conditioning a surrounding environment, an environment state variable calculating step that calculates, via a processor, an environment state variable for indicating the state of the surrounding thermal environment of a space occupied by the informant, based on an environment element measured value collected from the space occupied by the informant;

a dissatisfaction level deriving step that calculates, via the processor, a first and second dissatisfaction level regarding the surrounding thermal environment of the informant based on the environment state variable, an identifying step that calculates, via the processor, the need from the informant as a temporary need or as a persistent need based on the dissatisfaction level, wherein the dissatisfaction level deriving step includes a step that calculates the first dissatisfaction level corresponding to occupants in the surrounding environment feeling too hot and the second dissatisfaction level corresponding to the occupants feeling too cold; and the identification processing step includes a step that identifies the need reported by the informant as a temporary need if:

the need from the informant indicates the informant is too cold when the environmental state variable corresponds to occupants feeling too hot or the need reported by the informant indicates the informant is too hot when the environmental state variable corresponds to occupants feeling too cold, and identifies other needs as persistent needs; and a control plan determining step that establishes, in response to a temporary need being identified, that a control setting value of the device will change in accordance with the need from the informant, and that the control setting value will be returned to a value from prior to the change after a specific sustaining time has elapsed; and in response to a persistent need being identified, establishes that the control setting value will be changed on a persistent basis in accordance with the need from the informant.

* * * * *